US008602802B2

(12) United States Patent
Sanchez

(10) Patent No.: US 8,602,802 B2
(45) Date of Patent: Dec. 10, 2013

(54) EASY ASSEMBLING ONE CLICK BULB SOCKET

(76) Inventor: Isaac Sanchez, Miami, FL (US)

( * ) Notice: Subject to any disclaimer, the term of this patent is extended or adjusted under 35 U.S.C. 154(b) by 0 days.

(21) Appl. No.: 13/398,841

(22) Filed: Feb. 17, 2012

(65) Prior Publication Data

US 2012/0214354 A1 Aug. 23, 2012

Related U.S. Application Data

(60) Provisional application No. 61/463,437, filed on Feb. 17, 2011.

(51) Int. Cl.
*H01R 4/38* (2006.01)

(52) U.S. Cl.
USPC ..... 439/257; 439/753

(58) Field of Classification Search
USPC ..... 439/257, 253, 753, 616
See application file for complete search history.

(56) References Cited

U.S. PATENT DOCUMENTS 1,907,422 A * 5/1933 Long ..... 439/257
2,071,769 A * 2/1937 Schlicker et al. ..... 439/257
3,165,370 A * 1/1965 Laub, Sr ..... 439/257
3,504,329 A * 3/1970 Peterson et al. ..... 439/257
3,649,955 A 3/1972 Schmidt et al.
3,737,837 A 6/1973 Whitehead
4,572,601 A 2/1986 Jones et al.
4,854,896 A * 8/1989 Warshawsky ..... 439/703
RE33,123 E 12/1989 Corsetti
4,886,994 A 12/1989 Ragge, Jr.
5,853,299 A 12/1998 Wu
7,413,456 B1 * 8/2008 DiFusco ..... 439/257
7,833,059 B2 * 11/2010 Henrici et al. ..... 439/615

* cited by examiner

*Primary Examiner* — Gary F. Paumen
(74) *Attorney, Agent, or Firm* — Lyman Moulton, Esq.; Moulton Patents, PLLC.

(57) ABSTRACT

An easily assembling light bulb socket as disclosed secures a light bulb in a single clicking action. The disclosed socket comprises an electrically conductive sleeve configured to clasp a threaded end of the light bulb. The sleeve comprises a bump configured to slide into a thread recess and click-secure the bulb in the sleeve. A first disk received into the socket is riveted to the sleeve and to a metallic ribbon. The sleeve rivet makes a connection with a first wire and the ribbon rivet makes a connection with a second wire. The socket additionally comprises a second disk defining two holes aligned with the rivet holes in the first disk to receive a respective wire there through. The second disk holes include elliptical recesses configured to channel and secure the first and second wires between the disks when the second disk is axially rotated adjacent the first disk.

20 Claims, 8 Drawing Sheets

300

EASY ASSEMBLING ONE CLICK BULB SOCKET

CROSS-REFERENCE TO RELATED APPLICATION

This application claims the benefit of the priority date of earlier filed U.S. Provisional Patent Application Ser. No. 61/463,437, filed Feb. 17, 2011 for Isaac Sanchez titled, Easy Socket One, incorporated herein by reference in its entirety.

BACKGROUND OF THE INVENTION

Conventional threaded light bulb sockets for incandescent bulbs are notorious for difficult removal of the bulbs when over time a bulb may become jammed in the socket. A light bulb may therefore break from the threaded base and present a electrical shock hazard to a user of the socket. Removal of the bulb from the socket after the threaded base has broken from the glass globe can be dangerous if not annoying and problematic.

Also, it is not always easy or convenient to maintain bulbs in threaded light bulb sockets. Hard to reach threaded sockets in high ceilings do not lend themselves to turning from below. Large arrays of sockets present a serious cumulative time expenditure for unthreading and threading each one even if every socket is easily accessed.

Threaded sockets and bulbs have been tolerated over the years because they make dependable and predictable electrical connections. However, there is a long felt need for a quicker, easier and safer way of connecting light bulbs to a power supply.

SUMMARY OF THE INVENTION

An easily assembling light bulb socket as disclosed is configured to secure a light bulb in a single clicking action for electrical connection to a power supply. The disclosed light bulb socket comprises an electrically conductive sleeve configured to clasp a threaded end of the light bulb. The sleeve comprises two arms and a foot and at least one protuberance or bump configured to slide into a thread recess and click secure the bulb in the sleeve. The sleeve foot defines a rivet hole for a connection with a first wire. The light bulb socket also comprises a first disk riveted to the sleeve through the rivet hole in the foot thereof. The first disk is also riveted to a metallic ribbon radially cantilevered over an axial side of the disk. The riveted end of the ribbon defines a second rivet hole configured for an electrical connection with a second wire. The light bulb socket additionally comprises a second disk defining two holes aligned with the rivet holes in the first disk to receive a respective wire there through. Each hole in the second disk includes an elliptical recess configured to channel and secure the first and second wires between the disks when the second disk is axially rotated adjacent the first disk. Furthermore, a cylindrical socket is configured to receive the sleeve and the disks via a first open end. The socket also receives a light bulb in a second open end. The first end of the socket defines a rib stop for the first disk and a post-slot lock for the second disk adjacent the first disk. A cap component is configured to bayonet couple onto the outside wall of the first end of the socket, the cap defining an opening for a power supply cord of at least two insulated wires therein.

A method of easy assembly of a power cord to a light bulb in a socket as disclosed comprises fitting a first disk into a cylindrical socket via a socket first open end, the first end defining a rib stop for the first disk and an interior post-slot lock for a second disk adjacent the first disk, the socket also configured to receive a light bulb in a second open end. The method also includes extending the cord through an opening defined in a cap and threading the cord wires through the disks via a pair of aligned holes therein. The holes in the first disk comprise a respective rivet for a metallic ribbon and for the sleeve attached thereto. The rivets are configured to receive a respective cord wire. The method additionally includes partially turning the second disk adjacent to the first disk to secure the wires between the disks in an elliptical recess adjacent each hole in the second disk. The elliptical recesses are configured to channel and frictionally secure the wires between the unaligned and adjacent disks. The method further includes inserting a light bulb into the conductive sleeve configured to clasp the threaded end of the light bulb. The sleeve comprises two clasping arms and a sleeve rivet foot and at least one radial inwardly extending bump configured to slide into a thread recess and click secure the bulb in the sleeve.

Other aspects and advantages of embodiments of the disclosure will become apparent from the following detailed description, taken in conjunction with the accompanying drawings, illustrated by way of example of the principles of the disclosure.

Figure 1:
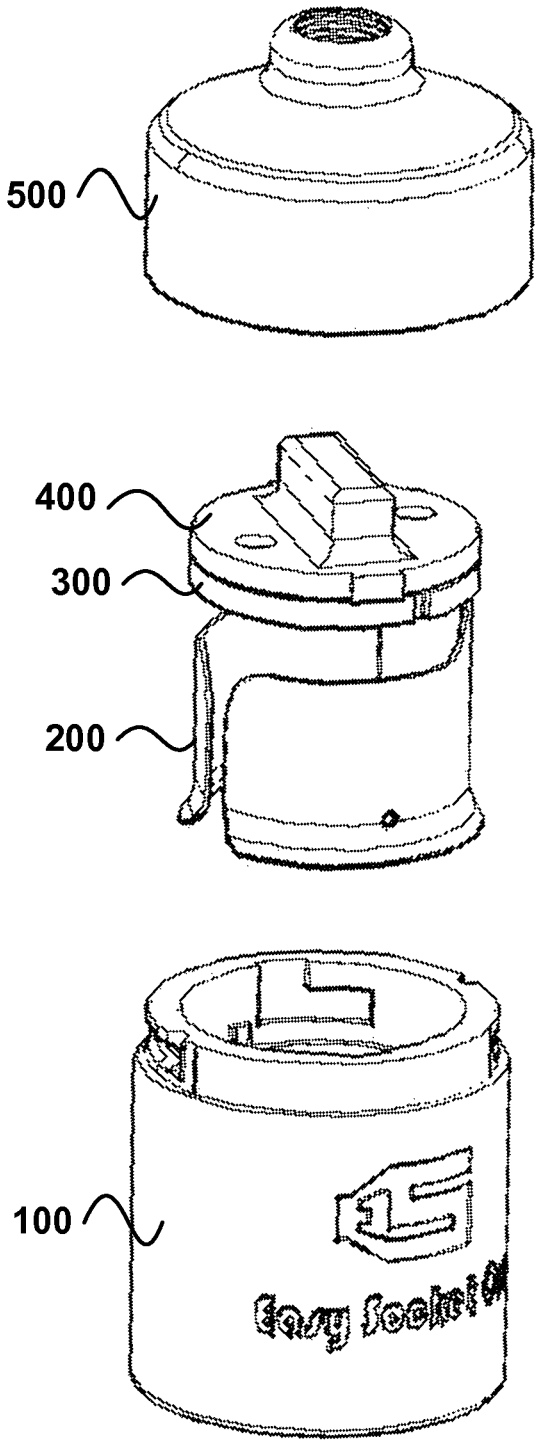
FIG. 1 is a perspective view of the parts of the easy assembling one click bulb socket in accordance with an embodiment of the present disclosure.

Throughout the description, similar reference numbers may be used to identify similar elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Embodiments of the disclosed easy assembling one click bulb socket and method for assembly may include all different types of lamp sockets accommodating different bulb sizes including a 26 mm, 27 mm, 12 mm and more. Lamp sockets with single throw switches and three way or multiple on/off switches are comprised in embodiments of the disclosure. Light sockets for ovens, refrigerators and other appliances may also benefit from the present disclosure and are included in embodiments herein.

Dimensions depicted in the various figures enable the formation of an embodiment of the disclosure but other larger and smaller sizes of various dimensions may also be included in embodiments of the disclosure. Dimensions depicted are nominal dimensions and may vary by plus or minus 10 percent for manufacturing tolerance unless otherwise called out differently. Dotted lines used for dimensioning form no part of the invention. Likewise, dotted lines for illustrative purposes (see bulb and lamppost shaft in FIG. 8) also form no part of the invention.

FIG. 1 is a perspective view of the parts of the easy assembling one click bulb socket in accordance with an embodiment of the present disclosure. The disclosed socket includes a socket body 100, a conductive sleeve 200, a first disk 300, a second disk 400 and a cap 500. Each part or component of the disclosed socket is detailed below in respective figures. The easily assembled light bulb socket as disclosed is configured to secure a light bulb in a single clicking action for electrical connection to a power supply.

Figure 2C:
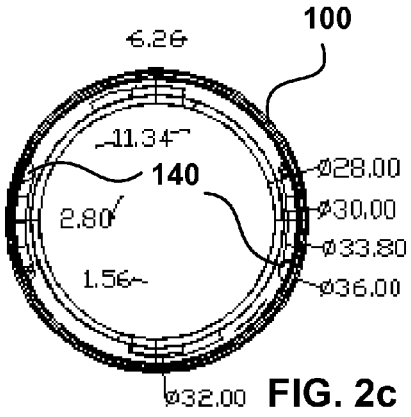
FIG. 2*c* is a bottom elevational view of the socket body in accordance with an embodiment of the present disclosure.
Figure 2A:
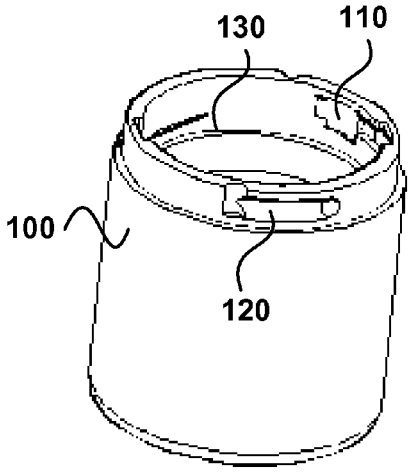
FIG. 2*a* is a perspective view of a socket body in accordance with an embodiment of the present disclosure.

FIG. 2*a* is a perspective view of a socket body in accordance with an embodiment of the present disclosure. The perspective view depicts a slot 110 for a post on the second disk 400 for a locking fit of the second disk in the socket body 100. Another slot, not depicted may complement the depicted slot for a post-slot pair to further lock in the second disk. The perspective view also depicts a slot 120 for a bayonet coupling of the cap 500 onto the outside wall of the socket body 100. A rib 130 formed on an inside wall of the socket body 100 acts as a stop for the insertion of the first disk 300 into the socket body 100. A bayonet locking connector uses some number of locking posts and slots to enable the two ends of a connector to mate and lock together with a twisting or turning motion. A bayonet locking connector most commonly has two locking posts but more may also be used in embodiments. Furthermore, the cylindrical socket body is configured to receive the sleeve 200 and the disks 300 and 400 via a first open end. The socket 100 also receives a light bulb in a second open end (see FIG. 8 below). The first end of the socket defines a rib stop 130 for the first disk 300 and a post-slot lock for the second disk 400 adjacent the first disk 300. The two clasping arms 210 and 220 of the conductive sleeve 200 are resiliently configured to a diameter smaller than a diameter of the light bulb screw base, the two arms 210 and 220 may be configured to partially enclose the screw base of the bulb and elastically expand and clasp around the threaded end of the light bulb. The foot 230 of the conductive sleeve 200 fractionally extends from an inside of the sleeve 200 to a portion of the radius of the sleeve 200 to avoid electrical contact with an insulated foot conductor on the screw base of the light bulb.

Figure 2B:
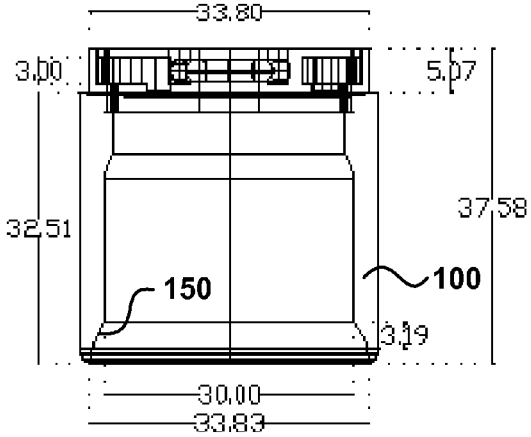
FIG. 2*b* is a side elevational view of the socket body in accordance with an embodiment of the present disclosure.

FIG. 2*b* is a side elevational view of the socket body in accordance with an embodiment of the present disclosure. Elements of the socket body depicted are similar or the same to the elements depicted in FIG. 2*a*. The socket depicted may be comprised of a transparent material so that internal surface lines are visible from the side view. A chamfered inside edge 150 of the second end of the socket body 100 allows an easy insertion of a light bulb of various sizes and shapes into the socket.

FIG. 2*c* is a bottom elevational view of the socket body in accordance with an embodiment of the present disclosure. Elements of the socket body depicted are similar or the same to the elements depicted in FIG. 2*a*. The bottom view depicts two protuberances or bumps 140 configured to be received into the notches of the first disk (see FIG. 3*a* below) to keep the first disk 300 from turning inside the socket body 100.

Figure 3D:
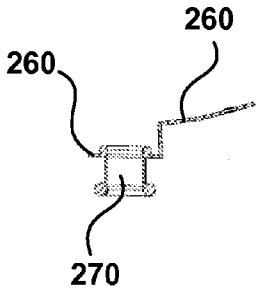
FIG. 3*d* is a side elevational view of a metallic ribbon and ribbon rivet part of the socket in accordance with an embodiment of the present disclosure.
Figure 3C:
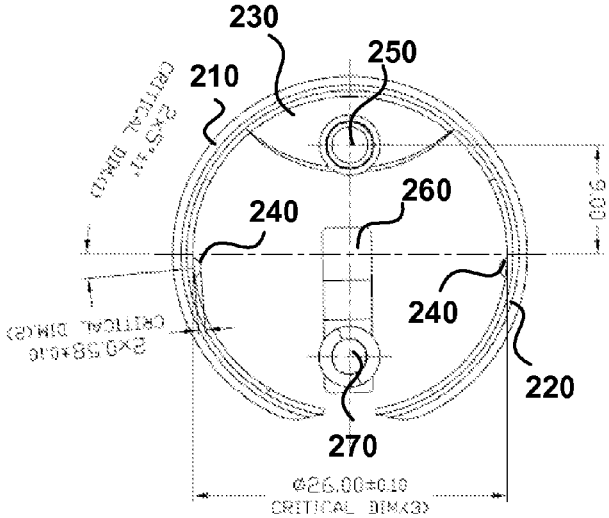
FIG. 3*c* is a bottom elevational view of the conductive sleeve part of the socket and the metallic ribbon in accordance with an embodiment of the present disclosure.
Figure 3A:
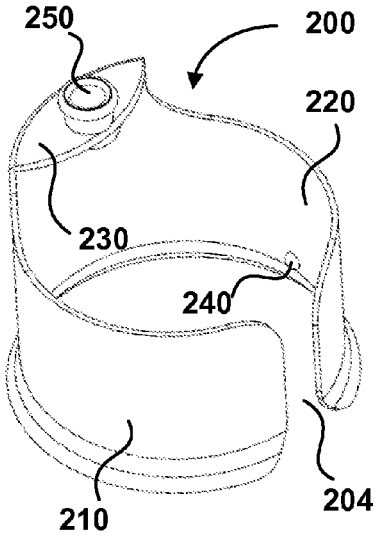
FIG. 3*a* is a perspective view of a conductive sleeve part of the socket in accordance with an embodiment of the present disclosure.

FIG. 3*a* is a perspective view of a conductive sleeve part of the socket in accordance with an embodiment of the present disclosure. The disclosed light bulb socket comprises an electrically conductive sleeve 200 configured to clasp a threaded end of the light bulb. The sleeve 200 comprises two arms 210 and 220 defining a gap 204 there between, a foot 230 and at least one protuberance or bump 240 configured to slide into a thread recess of a bulb and click secure the bulb in the sleeve 200. The sleeve foot 230 defines a rivet hole for a connection with a first wire via a rivet 250 in the sleeve rivet hole. The conductive sleeve 200 may be made of a resilient metal to an inner diameter of approximately 26 mm (millimeters) with a nominal manufacturing tolerance of ten percent when not clasping a light bulb. A protuberance 240 may comprise one of a bump, a bulge, a lump, a prominence and a bearing extending approximately 0.58 mm (millimeters) from an inside wall of the sleeve 200 with a nominal manufacturing tolerance of ten percent.

Figure 3B:
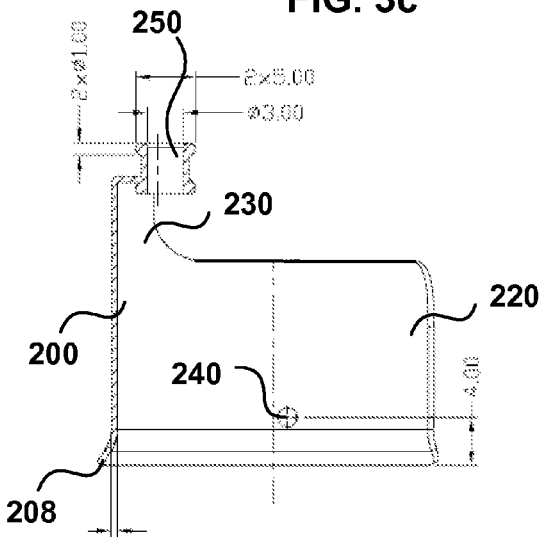
FIG. 3*b* is a side elevational view of the conductive sleeve part of the socket and the metallic ribbon in accordance with an embodiment of the present disclosure.

FIG. 3*b* is a side elevational view of the conductive sleeve part of the socket and the metallic ribbon in accordance with an embodiment of the present disclosure. Elements of the conductive sleeve depicted are similar or the same to the elements depicted in FIG. 3*a*. A flange 208 on a bulb receiving end of the sleeve 200 facilitates the insertion of various bulb sizes and shapes into the sleeve 200. The bump or protuberance 240 may be formed by a punch on the outer wall of the sleeve 200 forming a convexity or bump on the inside wall of the sleeve 200. A bump 240 on each clasping arm near a light bulb receiving end of the sleeve 200 provides further click setting of a bulb into the socket assembly.

FIG. 3*c* is a bottom elevational view of the conductive sleeve part of the socket and the metallic ribbon in accordance with an embodiment of the present disclosure. Elements of the conductive sleeve depicted are similar or the same to the elements depicted in FIG. 3*a*. The metallic ribbon 260 is shown with the ribbon rivet 270 through which the ribbon 260 attaches to the first disk 300 in relative position to the conductive sleeve 200. The foot 230 is depicted in an opposing arc to the sleeve but may take other shapes in embodiments of the present disclosure as need for mechanical stability comprising multiple rivets to the first disk 300. The rivets 250 and 270 receive wires of opposite electrical polarities and therefore remain discretely fixed on the first disk 300.

FIG. 3*d* is a side elevational view of a metallic ribbon and ribbon rivet part of the socket in accordance with an embodiment of the present disclosure. The metallic ribbon 260 is shaped into a 'Z' to enable an inherent spring action against the foot of a bulb inserted into the socket assembly. Other spring-like configurations are comprised in embodiments of the disclosure. The ribbon may be approximately 4.0 mm wide in embodiments of the disclosure. The ribbon rivet 270 attaches the ribbon to the first disk and provides reception for a wire to make electrical connection with the foot of a bulb inserted into the socket assembly.

Figure 4C:
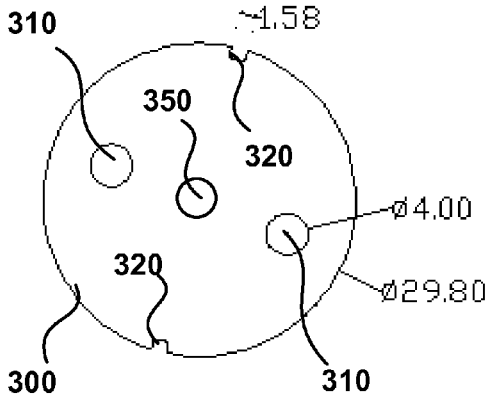
FIG. 4*c* is a bottom elevational view of the first disk part of the socket in accordance with an embodiment of the present disclosure.
Figure 4A:
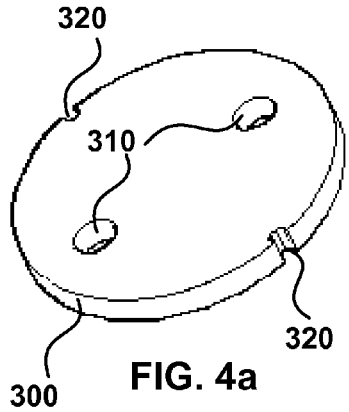
FIG. 4*a* is a perspective view of a first disk part of the socket in accordance with an embodiment of the present disclosure.

FIG. 4*a* is a perspective view of a first disk part of the socket in accordance with an embodiment of the present disclosure. The first disk 300 is made of a rigid material non-conductive to electricity. The first disk 300 may be riveted to the sleeve 200 through the rivet hole in the foot of the sleeve 230. The first disk 300 may also be riveted to the metallic ribbon 260 radially cantilevered over an axial side of the disk 300. The riveted end of the ribbon defines a second rivet hole and rivet 270 configured for an electrical connection with a second wire.

Figure 4B:
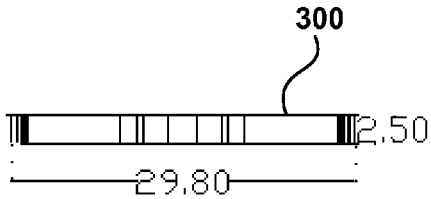
FIG. 4*b* is a side elevational view of the first disk part of the socket in accordance with an embodiment of the present disclosure.

FIG. 4*b* is a side elevational view of the first disk part of the socket in accordance with an embodiment of the present disclosure. Elements of the conductive sleeve depicted are similar or the same to the elements depicted in FIG. 4*a*. The first disk may be 2.50 mm thick and approximately 29.80 mm in diameter in an embodiment of the disclosure. An additional hole 350 centrally defined in the first disk 300 and a spring (not depicted) may be disposed therein between the second disk 400 and the cantilevered metallic ribbon 260, the spring configured to provide tension against the metallic ribbon 260 on an insulated foot conductor of the light bulb.

FIG. 4*c* is a top elevational view of the first disk part of the socket in accordance with an embodiment of the present disclosure. Elements of the conductive sleeve depicted are similar or the same to the elements depicted in FIG. 4*a*. The rivet holes 310 in the first disk 300 may be approximately 4.0 mm in diameter. The notches in the first disk 300 may be approximately 1.58 mm wide and approximately 1.58 mm deep.

Figure 5D:
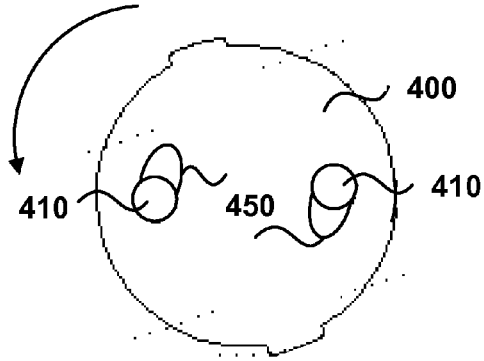
FIG. 5*d* is a bottom elevational view of the second disk part of the socket in accordance with an embodiment of the present disclosure.
Figure 5C:
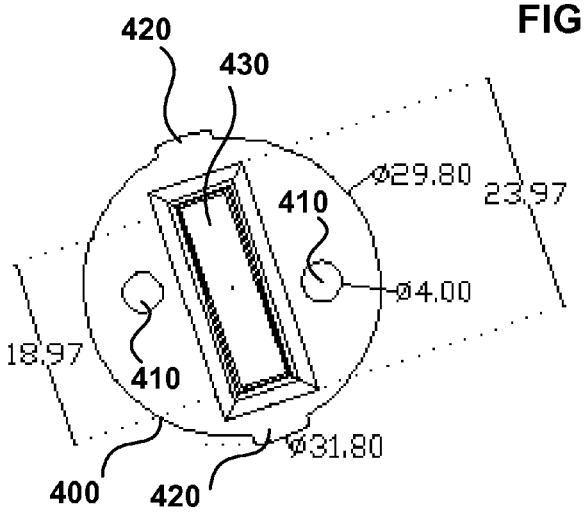
FIG. 5*c* is a top elevational view of the second disk part of the socket in accordance with an embodiment of the present disclosure.
Figure 5A:
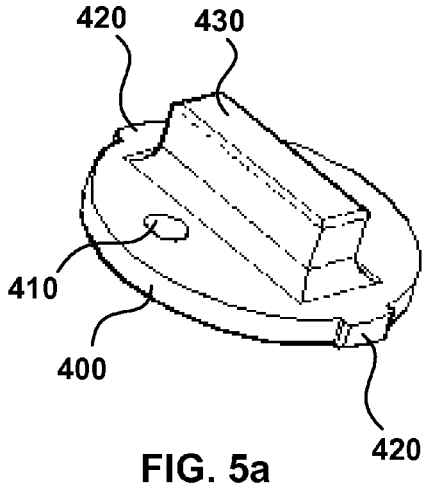
FIG. 5*a* is a perspective view of a second disk part of the socket in accordance with an embodiment of the present disclosure.

FIG. 5*a* is a perspective view of a second disk part of the socket in accordance with an embodiment of the present disclosure. The light bulb socket additionally comprises a second disk 400 defining two holes 410 (only one hole is shown) aligned with the rivet holes in the first disk 300 to receive a respective wire there through. The posts 420 are inserted into a complementary slot defined in the socket body 100 to lock the second disk 400 adjacent the first disk 300 adjacent the rib 130 in the socket body to provide a mechanically secure fixture of the disks in the socket body. The second disk 400 further comprises a knob structure 430 on a top side of the second disk opposing the side adjacent with the first disk 300. The knob structure 430 may be configured to provide a radial offset for a user to grip and axially rotate the second disk 400 in the socket body 100 and thereby post-slot lock in the first disk 300 and second disk 400 into the socket body 100. The knob structure 430 on the second disk may also be configured to provide a stress relief for the power cord entering the cap component coupled to the socket. The knob structure may also be configured to provide a splitter for the first wire and the second wire leaving the power conducting cord inside the assembled socket.

Figure 5B:
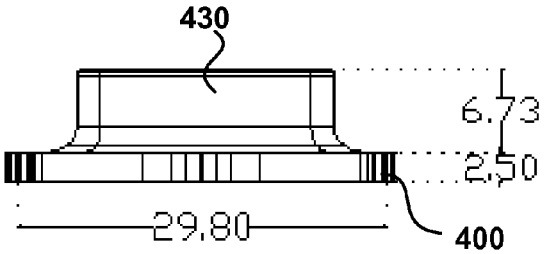
FIG. 5*b* is a side elevational view of the second disk part of the socket in accordance with an embodiment of the present disclosure.

FIG. 5*b* is a side elevational view of the second disk part of the socket in accordance with an embodiment of the present disclosure. Elements of the conductive sleeve depicted are similar or the same to the elements depicted in FIG. 5*a*. The knob extension 430 may take different shapes conducive to an operator's hand and include knurled and grip assisting surfaces.

FIG. 5*c* is a bottom elevational view of the second disk part of the socket in accordance with an embodiment of the present disclosure. Elements of the conductive sleeve depicted are similar or the same to the elements depicted in FIG. 5*a*. Holes 410 may be diametrically located on either side of the knob extension 430.

FIG. 5*d* is a bottom elevational view of the second disk part of the socket in accordance with an embodiment of the present disclosure. Elements of the conductive sleeve depicted are similar or the same to the elements depicted in FIG. 5*a*. Each hole 410 in the second disk 400 may include an elliptical recess 450 configured to channel and secure the first and second wires between the disks when the second disk 400 is axially rotated adjacent the first disk 300. The curved arrow indicates a clockwise rotation of the second disk 300 as viewed from the knobside of the disk 300. The rotation therefore channels wires inserted through the holes 410 into the elliptical channels 450 locking or securing them mechanically in place to allow the electrical connection with respective rivets in the first disk 300 to be mechanically stress free.

Figure 6C:
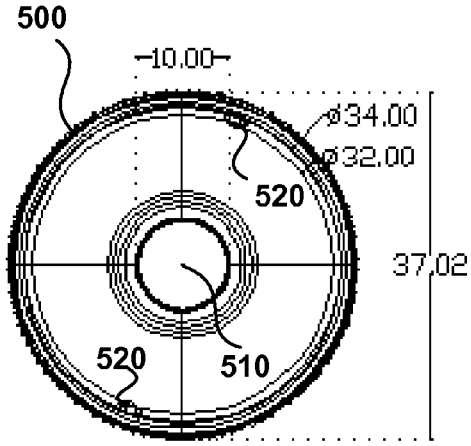
FIG. 6*c* is a bottom elevational view of the cap part of the socket in accordance with an embodiment of the present disclosure.
Figure 6A:
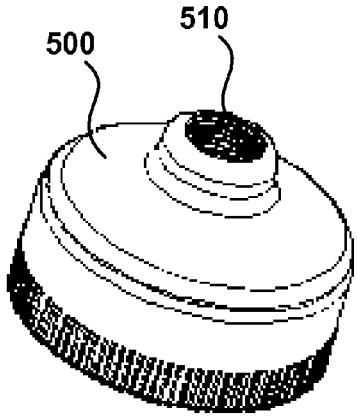
FIG. 6*a* is a perspective view of a cap part of the socket in accordance with an embodiment of the present disclosure.

FIG. 6*a* is a perspective view of a cap part of the socket in accordance with an embodiment of the present disclosure. The cap component 500 may be configured to bayonet couple onto the outside wall of the first end of the socket 100, the cap 500 defining an opening 510 for a lamppost shaft carrying a power supply cord of at least two insulated wires therein. The cap component 500 may comprise a knurled outside perimeter 520 configured as a grip for a user in assembling the light bulb socket to the cap 500 via the bayonet coupling therein. The cap component central opening 510 may be formed at a nipple end of the cap and an inside of the opening is threaded to receive one of a threaded lamp post and a threaded rod. A metallic bolt or shaft may be screw into and extend through the threaded opening and provide a threaded male end for lamppost assembly.

Figure 6B:
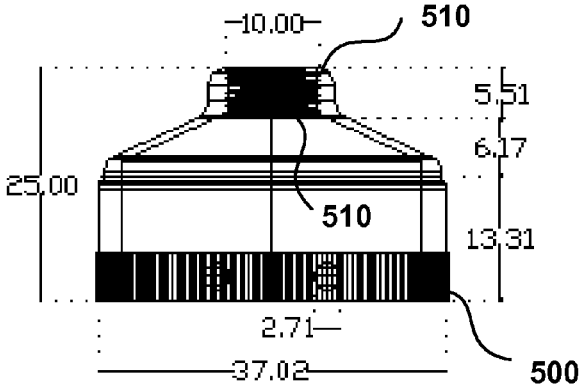
FIG. 6*b* is a side elevational view of the cap part of the socket in accordance with an embodiment of the present disclosure.

FIG. 6*b* is a side elevational view of the cap part of the socket in accordance with an embodiment of the present disclosure. Elements of the conductive sleeve depicted are similar or the same to the elements depicted in FIG. 6*a*. The cap 500 may be comprised of any rigid material and does not necessarily need to be non-conductive to electricity. Also, the opening 510 may be 10.00 mm in diameter but may be non-centrally placed in an embodiment of the disclosure.

FIG. 6*c* is a bottom elevational view of the cap part of the socket in accordance with an embodiment of the present disclosure. Elements of the conductive sleeve depicted are similar or the same to the elements depicted in FIG. 5*a*. An outside diameter of the cap 500 may nominally be 37.02 mm with a plus or minus 10 percent manufacturing tolerance. The post or bumps 520 form part of the bayonet coupling of the cap 500 to the socket body 100 per the slots 120 placed on opposing sides of each complementary component.

Figure 7:
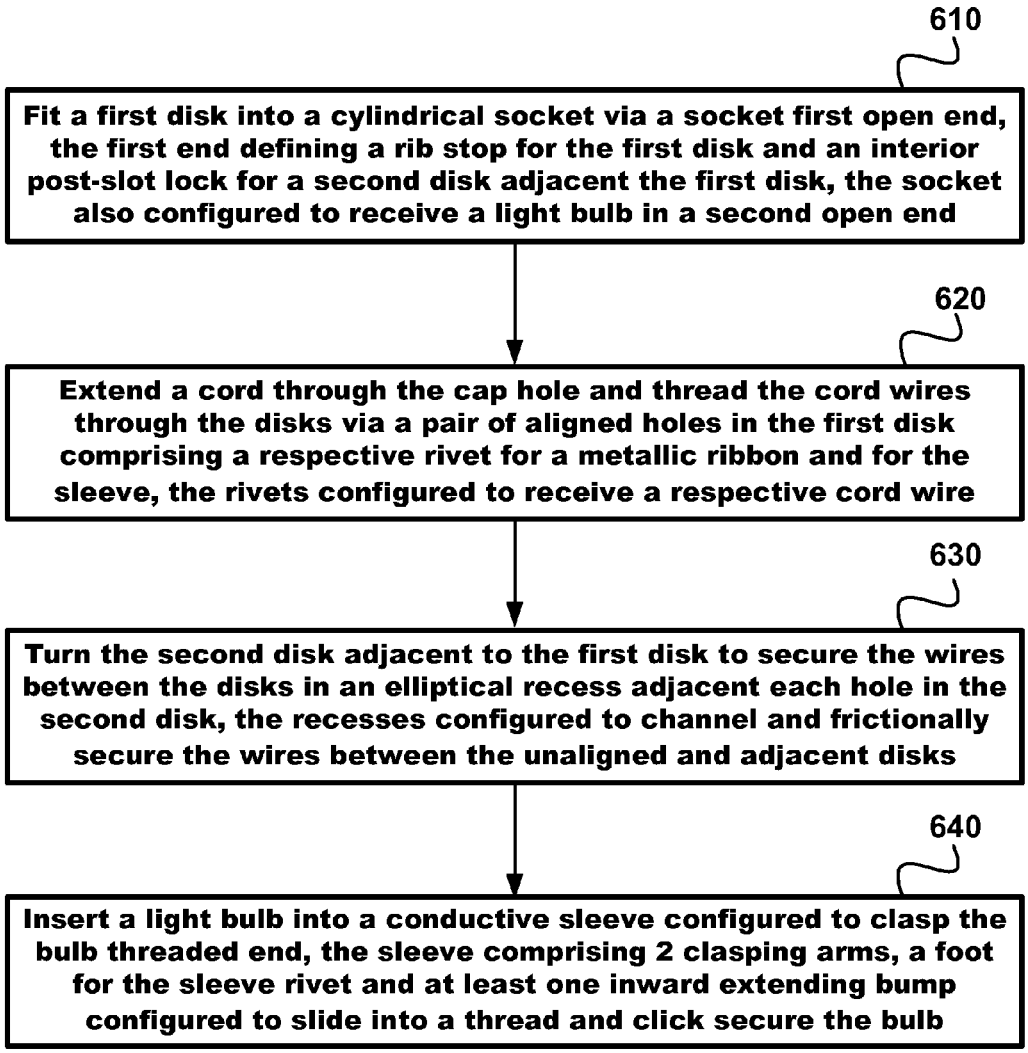
FIG. 7 depicts a flow chart of a method for easy assembly of a power cord to a light bulb in a socket in accordance with an embodiment of the present disclosure.

FIG. 7 depicts a flow chart of a method for easy assembly of a power cord to a light bulb in a socket in accordance with an embodiment of the present disclosure. The method comprises fitting 610 a first disk into a cylindrical socket via a socket first open end, the first end defining a rib stop for the first disk and an interior post-slot lock for a second disk adjacent the first disk, the socket also configured to receive a light bulb in a second open end. The method also includes extending 620 the cord through an opening defined in a cap and threading the cord wires through the disks via a pair of aligned holes therein. The holes in the first disk comprise a respective rivet for a metallic ribbon and for the sleeve attached thereto. The rivets are configured to receive a respective cord wire. The method additionally includes partially turning 630 the second disk adjacent to the first disk to secure the wires between the disks in an elliptical recess adjacent each hole in the second disk. The elliptical recesses are configured to channel and frictionally secure the wires between the unaligned and adjacent disks. The method further includes inserting 640 a light bulb into the conductive sleeve configured to clasp the threaded end of the light bulb. The sleeve comprises two clasping arms and a sleeve rivet foot and at least one radial inwardly extending bump configured to slide into a thread recess and click secure the bulb in the sleeve.

Embodiments of the disclosed method include clicking the bump against successive thread recesses on the bulb threaded end until a foot end of the bulb abuts the ribbon connector in the first disk. The embodiment may also comprise removing the light bulb from the socket via a simple pulling action from a user's hand on the light bulb, the socket securable via one of the user's other hand and a lamp fixture. The method may additionally comprise bayonet coupling the cap onto an exterior wall of the socket at the socket first end.

Figure 8:
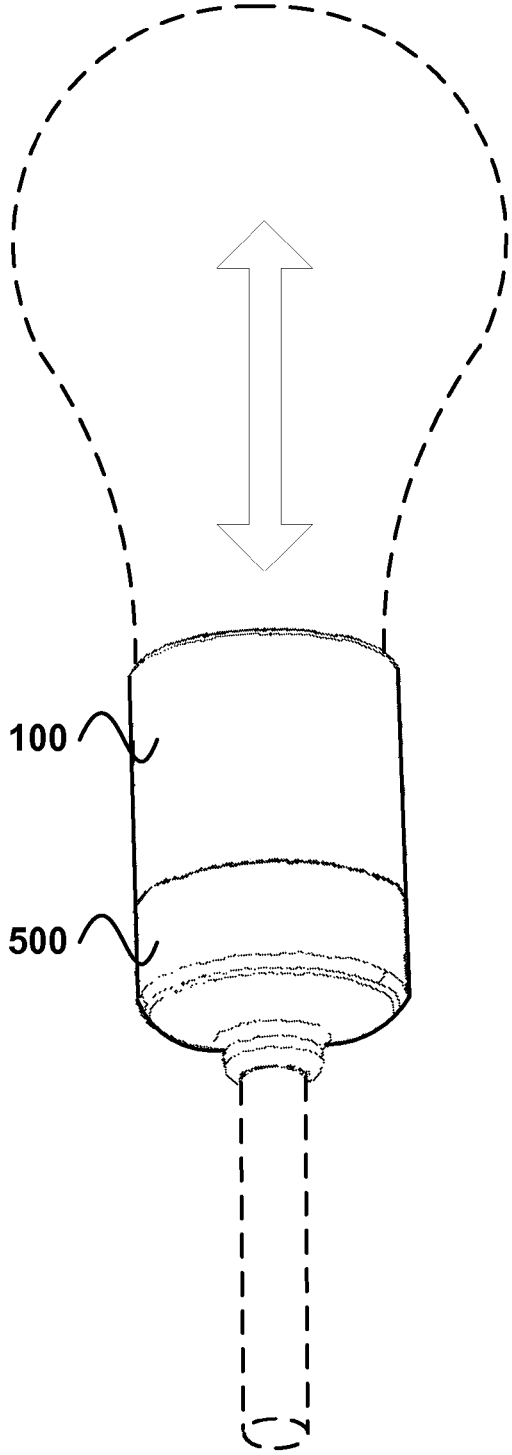
FIG. 8 depicts a fully assembled one click bulb socket with a light bulb and a lamppost shaft in accordance with an embodiment of the present disclosure.

FIG. 8 depicts a fully assembled one click bulb socket with a light bulb and a lamppost shaft in accordance with an embodiment of the present disclosure. The double headed arrow superimposed on the light bulb indicates the direction of insertion and removal of the bulb into and from the disclosed bulb socket. The light bulb socket configured to secure a screw base of a light bulb for electrical connection to a power supply cord, the light bulb socket may comprising an electrically conductive sleeve configured to clasp a threaded end of the light bulb. The sleeve may comprise a foot and two clasping arms and a bump on each arm configured to slide into a thread recess and click secure the bulb in the sleeve, the foot defining a rivet hole for a connection with a first wire. A first disk may be riveted to the sleeve through the rivet hole in the foot thereof, the disk also riveted to a metallic ribbon radially cantilevered over an axial side of the disk. The riveted end of the ribbon may define a second rivet hole configured for an electrical connection with a second wire. A second disk may define two holes configured to align with the rivet holes in the first disk to receive a respective wire there through, each hole comprising an elliptical recess configured to channel and secure the first and second wires between the disks when the second disk is turned with respect to the first disk. A cylindrical socket may be configured to receive the sleeve and the disks via a first open end and to receive a light bulb in a second open end, the first end defining a rib stop for the first disk and a post-slot lock for the second disk adjacent the first disk and a bayonet coupling on an outside wall thereof. A cap component may be configured to bayonet couple onto the outside wall of the first end of the socket, the cap defining an central threaded opening for a power supply cord carrying threaded rod.

Components which are non-conductive to electricity may be resistant to high temperatures, such as the bakelite, ceramics or plastics of high resistive coefficients. These pieces are made of a metal mold in a special machine of injection in hot. Electrically non-conductive or insulating components may include ceramics, glass and high tensile non-flammable composite products.

Various types of light bulbs may be inserted into the disclosed easy assembling one click bulb socket such as incandescent and fluorescent and any other type of threaded or notched end bulb. A bulb may be inserted and removed with little force and yet remain firmly affixed to the disclosed socket in any position. The disclosed socket may be mounted to a lamppost, to a hollow shaft carrying wire conductors or may simply be attached to a power cord. Because the disclosed socket is easily assembled to a power conductor, large arrays of lights such as signage and emergency lighting may be quickly produced and maintained. Also, hard to reach sockets may be serviced through remote mechanical means such as extension arm devices through a straight one click operation.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents to be included by reference in a non-provisional utility application.

What is claimed is:

1. A light bulb socket configured to secure a light bulb for electrical connection to a power supply, the light bulb socket, comprising:

an electrically conductive sleeve configured to clasp a threaded end of the light bulb, the sleeve comprising two arms and a foot and at least one protuberance configured to slide into a thread recess and click secure the bulb in the sleeve, the foot defining a rivet hole for a connection with a first wire;

a first disk riveted to the sleeve through the rivet hole in the foot thereof, the first disk also riveted to a metallic ribbon radially cantilevered over an axial side of the disk, the riveted end of the ribbon defining a second rivet hole configured for an electrical connection with a second wire;

a second disk defining two holes aligned with the rivet holes in the first disk to receive a respective wire there through, each hole having an elliptical recess configured to channel and secure the first and second wires between the disks when the second disk is axially rotated adjacent the first disk;

a cylindrical socket configured to receive the sleeve and the disks via a first open end and to receive a light bulb in a second open end, the first end defining a rib stop for the first disk and a post-slot lock for the second disk adjacent the first disk and a bayonet coupling on an outside wall thereof; and a cap component configured to bayonet couple onto the outside wall of the first end of the socket, the cap defining an opening for a power supply cord of at least two insulated wires therein.

2. The light bulb socket of claim 1, wherein the two clasping arms of the conductive sleeve are resiliently configured to a diameter smaller than a diameter of the light bulb screw base, the two arms configured to partially enclose the screw base and elastically expand and clasp around the threaded end of the light bulb.

3. The light bulb socket of claim 1, wherein the foot of the conductive sleeve fractionally extends from an inside of the sleeve to a portion of the radius of the sleeve to avoid electrical contact with a an insulated foot conductor on the screw base of the light bulb.

4. The light bulb socket of claim 1, wherein the socket second end comprises a chamfered edge to receive light bulbs of various sizes, lengths and shapes.

5. The light bulb socket of claim 1, wherein the metallic ribbon is formed into a 'Z' shape to provide inherent spring force against the foot of the bulb inserted into the sleeve.

6. The light bulb socket of claim 1, wherein the cap component central opening is formed at a nipple end of the cap and an inside of the opening is threaded to receive one of a threaded lamp post and a threaded rod.

7. The light bulb socket of claim 6, further comprising a metallic bolt configured to screw into and extend through the threaded opening and provide a threaded male end for lamp-post assembly.

8. The light bulb socket of claim 1, wherein the first disk component comprises at least one notch in a perimeter thereof, the notch configured to align with a protuberance on an inside wall of the socket body and fix the first disk in a predetermined position.

9. The light bulb socket of claim 1, wherein the second disk further comprises a knob structure on a second side of the second disk opposing the side adjacent with the first disk, the knob structure configured to provide a radial offset for a user to grip and axially rotate the second disk in the socket and thereby post-slot lock in the first and second disks into the socket.

10. The light bulb socket of claim 1, wherein the knob structure on the second disk is configured to provide a stress relief for the power cord entering the cap component coupled to the socket, the knob structure also configured to provide a splitter for the first wire and the second wire leaving the power conducting cord.

11. The light bulb socket of claim 1, further comprising a hole centrally defined in the first disk and a spring disposed therein between the second disk and the cantilevered metallic ribbon, the spring configured to provide tension against the metallic ribbon on an insulated foot conductor of the light bulb.

12. The light bulb socket of claim 1, wherein the conductive sleeve is made of a resilient metal to an inner diameter of approximately 26 mm (millimeters) with a nominal manufacturing tolerance of ten percent when not clasping a light bulb.

13. The light bulb socket of claim 1, wherein a protuberance comprises one of a bump, a bulge, a lump, a prominence and a bearing extending approximately 0.58 mm (millimeters) from an inside wall of the sleeve with a nominal manufacturing tolerance of ten percent.

14. The light bulb socket of claim 1, wherein the at least one protuberance on the sleeve comprises a protuberance on each clasping arm near a light bulb receiving end of the sleeve.

15. A method of easy assembly of a power cord to a light bulb in a socket, the method comprising:

fitting a first disk into a cylindrical socket via a socket first open end, the first end defining a rib stop for the first disk and an interior post-slot lock for a second disk adjacent the first disk, the socket also configured to receive a light bulb in a second open end;

extending the cord through an opening defined in a cap and threading the cord wires through the disks via a pair of aligned holes therein, the holes in the first disk comprising a respective rivet for a metallic ribbon and for the sleeve attached thereto, the rivets configured to receive a respective cord wire;

partially turning the second disk adjacent to the first disk to secure the wires between the disks in an elliptical recess adjacent each hole in the second disk, the elliptical recesses configured to channel and frictionally secure the wires between the unaligned and adjacent disks; and inserting a light bulb into a conductive sleeve configured to clasp the threaded end of the light bulb, the sleeve comprising two clasping arms and a foot for the sleeve rivet and at least one radial inwardly extending bump configured to slide into a thread recess and click secure the bulb in the sleeve.

16. The method of easy assembly of a power cord to a light bulb in a socket of claim 15, further comprising clicking the bump against successive thread recesses on the bulb threaded end until a foot end of the bulb abuts the ribbon connector in the first disk.

17. The method of easy assembly of a power cord to a light bulb in a socket of claim 15, further comprising removing the light bulb from the socket via a simple pulling action from a user's hand on the light bulb, the socket securable via one of the user's other hand and a lamp fixture.

18. The method of easy assembly of a power cord to a light bulb in a socket of claim 15, further comprising bayonet coupling the cap onto an exterior wall of the socket at the socket first end.

19. A light bulb socket configured to secure a screw base of a light bulb for electrical connection to a power supply cord, the light bulb socket, comprising:

an electrically conductive sleeve configured to clasp a threaded end of the light bulb, the sleeve comprising a foot and two clasping arms and a bump on each arm configured to slide into a thread recess and click secure the bulb in the sleeve, the foot defining a rivet hole for a connection with a first wire;

a first disk riveted to the sleeve through the rivet hole in the foot thereof, the disk also riveted to a metallic ribbon radially cantilevered over an axial side of the disk, the riveted end of the ribbon defining a second rivet hole configured for an electrical connection with a second wire;

a second disk defining two holes configured to align with the rivet holes in the first disk to receive a respective wire there through, each hole comprising an elliptical recess configured to channel and secure the first and second wires between the disks when the second disk is turned with respect to the first disk;

a cylindrical socket configured to receive the sleeve and the disks via a first open end and to receive a light bulb in a second open end, the first end defining a rib stop for the first disk and a post-slot lock for the second disk adjacent the first disk and a bayonet coupling on an outside wall thereof; and a cap component configured to bayonet couple onto the outside wall of the first end of the socket, the cap defining an central threaded opening for a power supply cord carrying threaded rod.

20. The light bulb socket of claim 19, wherein the conductive sleeve comprises a flanged end opposite the foot end, the flange configured to facilitate inserting the threaded end of the light bulb into the sleeve.

* * * * *